US009859649B2

(12) United States Patent
Konietzko et al.

(10) Patent No.: US 9,859,649 B2
(45) Date of Patent: Jan. 2, 2018

(54) PLUG ADAPTER FOR AN ELECTRICAL DEVICE FOR PLUGGING IN SUPPLY LINES, AND SYSTEM FORMED BY A PLUG ADAPTER AND A DEVICE

(71) Applicant: Eaton Electrical IP GmbH & Co. KG, Schoenefeld (DE)

(72) Inventors: Thomas Konietzko, Niederkassel (DE); Oliver Knoerrchen, Cologne (DE); Stephan Stanke, Rheinbach (DE)

(73) Assignee: EATON ELECTRICAL IP GMBH & CO. KG, Schoenefeld (DE)

( * ) Notice: Subject to any disclaimer, the term of this patent is extended or adjusted under 35 U.S.C. 154(b) by 0 days.

(21) Appl. No.: 15/323,998

(22) PCT Filed: Jun. 29, 2015

(86) PCT No.: PCT/EP2015/064659

§ 371 (c)(1),
(2) Date: Jan. 5, 2017

(87) PCT Pub. No.: WO2016/005215

PCT Pub. Date: Jan. 14, 2016

(65) Prior Publication Data

US 2017/0162977 A1 Jun. 8, 2017

(30) Foreign Application Priority Data

Jul. 5, 2014 (DE) ..... 10 2014 109 424

(51) Int. Cl.
*H01R 13/58* (2006.01)
*H01R 13/506* (2006.01)

(52) U.S. Cl.
CPC ..... *H01R 13/5829* (2013.01); *H01R 13/506* (2013.01)

(58) Field of Classification Search
CPC ..... H01R 13/5829; H01R 13/506
See application file for complete search history.

(56) References Cited

U.S. PATENT DOCUMENTS 4,566,749 A * 1/1986 Johnston ..... H01R 24/62 439/425
4,759,726 A * 7/1988 Naylor ..... H01R 4/5008 439/441

(Continued)

FOREIGN PATENT DOCUMENTS

DE 10137497 C1 5/2003
DE 10152347 C1 6/2003

(Continued)

*Primary Examiner* — Alexander Gilman
(74) *Attorney, Agent, or Firm* — Leydig, Voit & Mayer, Ltd.

(57) ABSTRACT

A plug adapter for plugging in electrical supply lines on the device, the device connection contacts being in adjacent rows, and contacted by the supply line via screwless clamping devices, has a prismatic-like structure of insulating molded material, and an upper side parallel to the device upper side, an output side facing the device, and an access side facing away from the device. Between the output side and access side are parallel supply line core receiving channels, in adjacent rows and corresponding to the device connection contacts. An actuating bracket is on the plug adapter, associated with the device's unlocking device for positioning the plug connection between plug adapter and device.

14 Claims, 2 Drawing Sheets

(56) References Cited

U.S. PATENT DOCUMENTS 4,768,981 A * 9/1988 Hohorst ..... H01R 4/4845 439/828
5,061,203 A * 10/1991 Allgood ..... H01R 4/4818 439/404
5,626,488 A * 5/1997 Albeck ..... H01R 4/2429 439/395
5,810,625 A * 9/1998 Klein ..... H01R 4/4845 439/441
5,876,237 A * 3/1999 Patel ..... H01R 4/4827 439/441
5,975,940 A * 11/1999 Hartmann ..... H01R 4/4818 439/441
6,250,950 B1 * 6/2001 Pallai ..... H01R 4/4836 439/439
6,261,120 B1 * 7/2001 Beege ..... H01R 4/4836 439/268
D500,742 S * 1/2005 Stadler ..... D13/147
7,329,143 B2 * 2/2008 Schrader ..... H01R 4/4827 439/441
8,062,077 B2 * 11/2011 Hayashi ..... H01R 4/4863 439/725
8,210,865 B2 * 7/2012 Hayashi ..... H01R 4/4836 439/409
8,398,430 B1 * 3/2013 Queru ..... H01R 31/06 439/536
8,444,443 B2 * 5/2013 Schafmeister ..... H01R 4/4836 439/441
8,512,068 B2 * 8/2013 Gassauer ..... H01R 4/4818 439/411
9,252,520 B1 * 2/2016 Weiden ..... H01R 4/4845
9,337,556 B2 * 5/2016 Rask ..... F04D 13/0686
9,437,940 B1 * 9/2016 Rao ..... H01R 4/4836
9,543,700 B2 * 1/2017 Kollmann ..... H01R 4/4836
2004/0217831 A1 * 11/2004 Bauer ..... H01H 11/0031 335/202
2007/0082551 A1 * 4/2007 Oesterhaus ..... H01R 4/4827 439/607.01
2009/0253306 A1 * 10/2009 Knoerrchen ..... H01R 4/4836 439/651
2013/0065427 A1 * 3/2013 Fleischmann ..... H01R 13/585 439/465
2015/0017833 A1 * 1/2015 Sato ..... H01R 4/184 439/519
2015/0079857 A1 * 3/2015 Kawamura ..... H01R 43/0482 439/877

FOREIGN PATENT DOCUMENTS

DE 102004043468 A1 3/2006
DE 102005056847 B4 6/2007
DE 202006013824 U1 10/2007
DE 102008017245 A1 10/2009
EP 1128471 A1 8/2001
EP 1667286 A2 6/2006
WO 2011137950 A1 11/2011

* cited by examiner

PLUG ADAPTER FOR AN ELECTRICAL DEVICE FOR PLUGGING IN SUPPLY LINES, AND SYSTEM FORMED BY A PLUG ADAPTER AND A DEVICE

CROSS-REFERENCE TO RELATED APPLICATIONS

This application is a U.S. national stage application under 35 U.S.C. §371 of International Application No. PCT/EP2015/064659, filed on Jun. 29, 2015, and claims benefit to German Patent Application No. DE 10 2014 109 424.7, filed on Jul. 5, 2014. The International Application was published in German on Jan. 14, 2016, as WO 2016/005215 A1 under PCT Article 21(2).

FIELD

The invention relates to a plug adapter for an electrical device for plugging electric supply lines into the device.

BACKGROUND

Clamping elements make it possible to connect and easily disconnect solid wires or fine-stranded conductors with wire end sleeves or with crimp contacts. The connection contacts are located in terminal chambers, whereby the connection contacts are in the form of a contact spring that has a free end. When a supply line is inserted, a free end of a contact spring is clamped with each supply line wire. The removal of the supply line is made possible when the free arm of the contact spring is acted upon by a decoupling finger so that the free arm of the contact spring is moved away from the supply line wire. This is how the clamping of the supply line wire is released.

German patent specification DE 10152347 C1 describes a plug adapter for a switching device. The supply lines are engaged into supply terminals. For purposes of removing the supply line wires, a tool has to be used with which the supply terminals can be opened. When it comes to these or similar plug adapters, the user normally has to perform several actions, often even with both hands.

A plug adapter referred to as a plug holder for a multipole incoming line made of insulating molded material has already been disclosed (German utility model DE 20 2006 013 824 U1). The plug adapter has a prismatic structure with a top that is parallel to the top of the device and an outgoing side facing the device as well as an incoming side facing away from the device. The conductor ends of the multipole incoming line end in plugs that are held by the plug adapter in receiving openings. Between the outgoing side and the incoming side, receiving channels for the plugs are arranged in parallel in a row next to each other, whereby these receiving channels are associated with connection contacts of the device. The plug adapter has latching elements that ensure the mechanical fit of the plug adapter on the device.

German patent application DE 10 2008 017 245 A1 shows a plug adapter that serves to receive an incoming line. The electric connection of the incoming line to the device is effectuated by means of plug-in tabs leading to the device. The plug adapter has a clamping element that serves to clamp the incoming line in the plug adapter.

A plug adapter that serves to connect a single conductor end to a terminal in an electrical device is already known (German patent application 10 2005 056 847 A1). The conductor end is affixed in a clamping element in the plug adapter. A plurality of these plug adapters are used in the case of a multi-wire incoming line.

German patent specification DE 10137497 C1 discloses a plug adapter that serves to connect a multipole incoming line to an electrical device. The plug adapter is configured as an adapter plug which, on the one hand, receives the conductor ends of the supply line and, on the other hand, can be connected mechanically and electrically via connection elements in the device.

German patent application DE 10 2004 043 468 A1 describes a switching device that has a switching element in at least one current path. The current path has an input plug contact and an output plug contact. The switching device is plugged into a plug connection module, whereby the input plug contacts and the output plug contacts bridge interruption points of an electric line. When the switching element in the switch device is actuated, the current in the electric line is either conveyed further or else interrupted.

SUMMARY

An aspect of the invention provides a plug adapter for an electrical device for plugging a multi-wire electric supply line into the electrical device, the connection contacts of the device being positioned in a row next to each other in the device, and the connection contacts being contacted mechanically and electrically by the multi-wire electric supply line via screwless clamping elements, the clamping elements being released by actuating a supply line unlocking element that includes decoupling fingers configured to release the clamping elements and being positioned at 90° relative to an incoming direction of a conductor, and the decoupling fingers protruding by a length of their actuation stroke from a device housing in a direction of a top of the electrical device. The plug adapter comprises: an approximately prismatic structure, the plug adapter including an insulating molded material; a top that is parallel to the top of the electrical device; an outgoing side facing the electrical device, the outgoing side being oriented in a direction of the connection contacts; an incoming side facing away from the electrical device, the incoming side being configured to receive one or more supply line wires receiving channels arranged in parallel and located between the outgoing side and the incoming side, the receiving channels being configured to each receive a respective one of the supply line wires, the receiving channels being associated with the connection contacts of the electrical device; and an actuation bar that, in an inserted position of the plug adapter, is located above the supply line unlocking element.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1B:
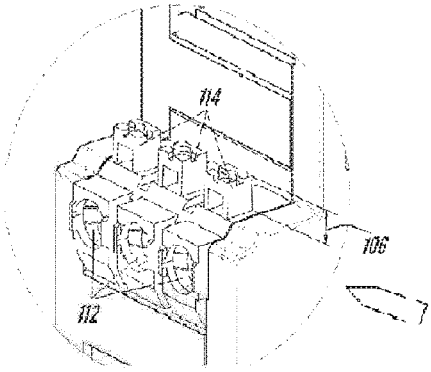
FIG. 1*a-b* electrical device, in detail.

An aspect of the invention provides a plug adapter for an electrical device for plugging supply lines into the device as well as a system formed by a plug adapter and a device. An aspect of the invention allows supply lines also those having conductors with different cross sections to be connected and disconnected without the use of tools and in a user-friendly manner.

A multipole, preferably three-pole, plug adapter for an electrical device is provided, especially for an electric switching device with which electric supply lines are contacted via screwless clamping connections. The plug adapter can easily be employed as an insertion and uncoupling aid for electric supply lines having different cross sections and different conductor terminating elements.

A system formed by the plug adapter and the device is also provided.

A connection contact is configured on the incoming side of the device for each pole on the device associated with the plug adapter. Several connection contacts are situated in a row next to each other. The connection contacts are configured as screwless clamping connections into which the supply line is inserted and affixed in order to establish electrical contact and to create a purely mechanical connection. The screwless clamping connections under discussion here are so-called push-in contact terminals. For each pole of the device or for each pole of the supply line, a single decoupling finger configured as an unlocking element is present on the connection contact of the device. The decoupling fingers are positioned at 90° relative to the incoming direction of the conductor and they protrude from the device housing in the direction of the top of the device by the length of their actuation stroke. For purposes of electrically and mechanically releasing and removing supply lines from connection contacts that have been inserted into the latter, each of the individual decoupling fingers on each connection contact has to be actuated.

The plug adapter has an approximately prismatic structure and is made of insulating molded material whose top is parallel to the top of the device (in the inserted position). An outgoing side facing the device and an incoming side facing away from the device are configured for supply lines on the plug adapter. Receiving channels arranged next to each other and running in parallel are located between the outgoing side and the incoming side for each supply line wire. The receiving channels are likewise associated with the connection contacts of the device.

The plug adapter may be provided in two variants. Variant A is in the form of a first, one-part plug adapter. The second variant B is in the form of a two-part plug adapter. The two-part plug adapter consists of two pieces, namely, an adapter top and an adapter bottom. Both variants of the plug adapter have the movable actuation bar.

On the top of the adapter, there is a movable actuation bar that serves as a dismantling or decoupling aid. When the plug adapter with line wires has been inserted into the device equipped with screwless connection technology (push-in clamps), the actuation bar is located above the unlocking means that is configured as a decoupling finger. According to the invention, all of the decoupling fingers can be pushed all at once by means of the actuation bar and the supply line wires can be decoupled. The decoupling fingers can be accessed and actuated by pushing down the actuation bar (manually) without the use of any special tool. The supply line wires are decoupled by means of the actuation bar; the plug adapter can be removed together with the supply line wires.

The actuation bar is arranged on the plug adapter by means of a film hinge (made of a web of material).

The supply lines can be solid individual conductors or else the ends of the supply lines can consist of tin-plated flexible leads. Preferably, crimp contacts or wire end sleeves are employed as conductor terminating elements for the flexible leads. The supply line wires can be single wires or double wires, whereby the latter preferably have crimp contacts as conductor terminating elements. For this reason, it is possible to mount (insert) or to dismantle (to remove) several conductors having different diameters all at once.

With the second variant B of the plug adapter, there are several receiving means configured as holding jaws in the adapter top, where the line wires are positioned and held in place by means of the conductor terminating elements. When the adapter top with the positioned lines is inserted into the adapter bottom, the movable holding jaws are clamped with the lines and affixed by the clamping bevels located in the adapter bottom.

The following details and features can be present, either on their own or combined with each other—if technically warranted.

On the adapter top, above the outgoing side of the plug adapter of the receiving channels, the actuation bar is configured in the form of a resilient film hinge.

The clearance of the receiving channels should be dimensioned in such a way that it is equal to or smaller than the diameter of the supply line wires. Owing to this measure, the supply line wires are held in the receiving channels, where they are clamped when force is applied, whereby the force of the clamping is greater than the force with which the supply line wires can be plugged into the connection contacts of the device. The supply line wires cannot shift as they are being plugged in.

It is also possible for elastically movable clamping jaws to be present in order to clamp the supply line wires, whereby the clamping jaws are arranged in the adapter top by means of film hinges. For purposes of enhancing the fixation of the inserted supply line wires, it is also possible to have clamping ribs on both sides on the inner surfaces of the clamping jaws. The clamping ribs run parallel to the orientation of the clamping jaws that define the receiving channels. With an eye towards augmenting the clamping effect, the adapter bottom can have U-shaped receiving troughs which move towards each other when the adapter top and the adapter bottom are assembled, thereby strengthening the clamping effect.

The receiving channels can be configured so as to hold an insulated single flexible lead or else an insulated double flexible lead.

In a special embodiment, the receiving channels can also be configured so as to hold a crimp contact that compresses the supply line wires. In such embodiments, crimp contacts into which two individual supply line wires or one double wire can be compressed can be used as the conductor terminating elements. For example, it would be possible to use a single supply line wire (flexible lead as a fine-stranded conductor) having a large conductor cross section (up to 2.5 $mm^2$) or else two single supply line wires that each have a conductor cross section of about 2.5 $mm^2$ for the above-mentioned conductor cross section.

The adapter top can be inserted into the adapter bottom parallel to the receiving channels, whereby, on one outgoing side of a first adapter part, there is a stop nose for the other adapter part, and on the other adapter part, there is an undercut associated with the stop nose.

The outgoing sides of the receiving channels can be configured with constricted openings that are equal to or smaller than the diameter of a conductor terminating element. The openings can be elastically enlarged, so that the inserted conductor wires are clamped in the openings and are also secured in place when the plug adapter is not plugged into the device.

In conclusion, the following advantages of the invention should be underscored: simple, safe, fast handling during the contacting step as well as during dismantling or decoupling of multi-wire supply lines from electrical devices. Due to the presence of the actuation bar, there is no need for any other tools to be used, whereby, in the case of arrangements known in the state of the art, it is usually necessary for the user to perform several actions, often even using both hands.

The plug adapter is safe since the user does not have any direct contact with the supply line wires. The invention can be quickly and easily retrofitted into existent supply lines and associated devices. The fixation of the supply line wires in the plug adapter prevents the occurrence of wiring errors.

The plug adapter is suitable for all electrical devices, especially for switching devices, that employ screwless push-in connection technology with which the decoupling fingers are positioned at 90° relative to the incoming direction of the conductor and are easily accessible (they protrude from the device).

The figures describe two variants of the plug adapter, whereby the same reference numerals are employed for identical parts in the variants.

The multipole plug adapters serve to establish a connection between an electric supply line having several wires and a multipole device for purposes of feeding current to the device. Three-pole plug adapters are shown in the figures as a typical embodiment.

The plug adapters have an approximately prismatic structure and are made of insulating molded material.

The supply lines can consist of solid single wires or else the wire ends of the supply line can be provided with conductor terminating elements (end sleeves, crimp contacts). For each pole, the switching device has a screwless clamping connection into which the supply line can be inserted in order to establish electrical contact. The insertion also brings about a purely mechanical fixation of the plug adapter to the device. The screwless clamping connection is a so-called push-in contact terminal. The terminals of the clamping connections can be released by means of an unlocking element. An actuation finger 42 is present as the unlocking element.

Typical conductor cross sections for the electrical device and for the plug adapter range from 1.0 $mm^2$ to 2.5 $mm^2$.

Figure 1A:
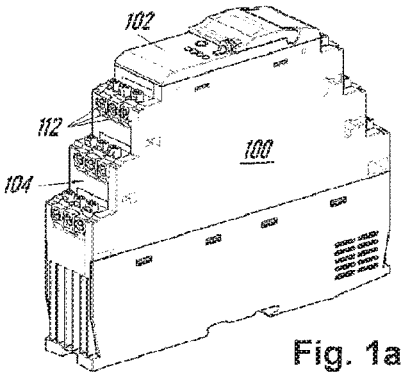

FIG. 1*a* shows an electrical device 100. The detail in FIG. 1*b* depicts the connection contacts 112 and the decoupling fingers 114 that are present on the device. Three connection contacts are situated next to each other, for example, in a row, on an incoming side 104 of the device. FIG. 1*a* shows a device configured as an electric switch which has three rows of connection contacts on each of two incoming sides. The incoming openings of the connection contacts are parallel to the incoming side.

It can be seen in the detailed drawing in FIG. 1*b* that the decoupling fingers 114 are situated in a row above the connection contacts and are oriented in their actuation direction by 90° relative to the incoming direction of the supply lines. The clamping in the screwless connection contacts is released by actuating the supply line unlocking element that is in the form of decoupling fingers. The decoupling fingers 114 protrude from the device housing by the length of their actuation stroke 106 in the direction of the top of the device.

Figure 2:
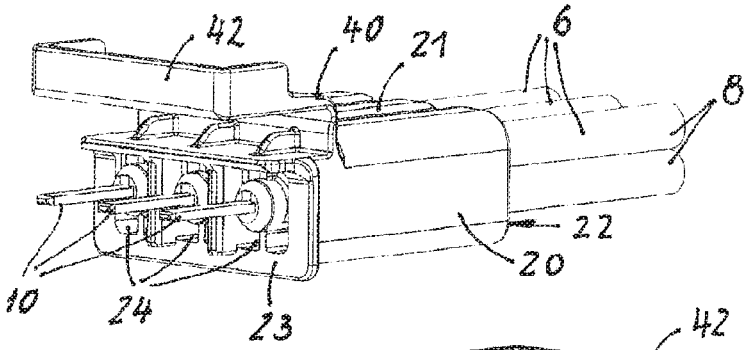
FIG. 2 one-part plug adapter.

FIG. 2 shows a perspective view of a one-part plug adapter 20 in which the free pluggable ends of the supply lines protrude from the receiving channels by a length from the plug adapter that is sufficient for plugging purposes. In the scenario being depicted, the plug adapter 20 is manufactured with the supply line wires 6 and it is ready to be connected to the electrical device.

The one-part plug adapter 20 for a three-pole supply line 2 has the following details: it has an approximately prismatic structure and is made of insulating molded material. When it is plugged in, its top 21 (31) is parallel to the top 102 of the electrical device. The incoming side 104 and the top 102 of the device are oriented by 90° relative to each other.

There is a receiving channel 24 for each supply line wire 6. The receiving channels are next to each other in a row and are associated with the device connection contacts 112.

The receiving channels 24 for the supply line wires 6 are parallel in the plug adapter and they have an incoming side 22 for the insertion of the supply line wires 6 as well as an outgoing side 23 in the direction of the connection contacts of the device. The supply line or the wires of the supply line are laid in the receiving channels in such a way that the ends of the supply line wires protrude from the outgoing sides of the receiving channels to such an extent that their length is sufficient for them to be held and clamped in the device connection contacts.

The figures do not show that the outgoing sides of the receiving channels can be configured with constricted openings. Here, the openings are equal to or smaller than the diameter of a conductor terminating element. The openings can be elastically enlarged so that the inserted line wires become clamped in the openings.

The receiving channels 24 and/or the outgoing openings of the receiving channels are preferably configured geometrically in such a way that a certain amount of force is needed to put the supply line wires in place, so that the supply line or the supply line wires are held so as to be clamped in the plug adapter.

The single-piece plug adapter 20 has a resilient actuation bar 42 which, in the position of the plug connection (in other words, in the plugged-in state), is associated with the unlocking element 114 on the device between the plug adapter and the device. This feature is shown in greater detail in FIG. 6. The actuation bar 42 is located on the top 21 of the plug adapter at the end of the molded element, where it faces the connection contacts on the device when it is plugged in. The actuation bar 42 is movably connected to the plug adapter by means of a film hinge 40.

The decoupling fingers 114 of the clamping element formed in the connection contacts are acted upon by the actuation bar 42, whereby the manual actuation of the actuation bar 42 causes them to touch the decoupling fingers 114, thus pushing them down all at once. As a result, the supply line wires inserted into the connection contacts are released.

Figure 3:
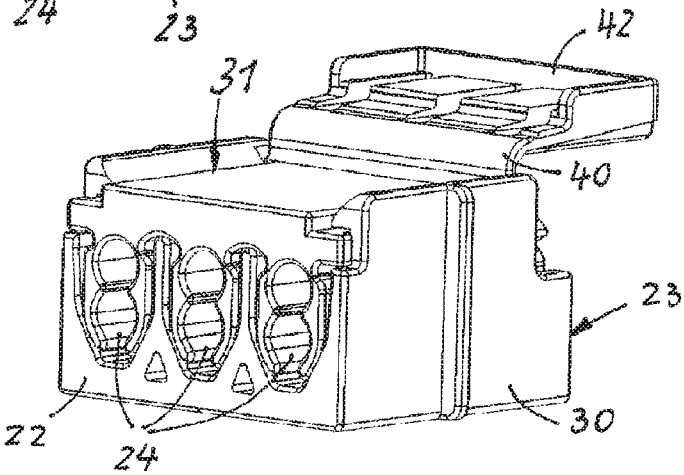
FIG. 3 two-part plug adapter.

FIG. 3 shows a two-part plug adapter 30 as viewed towards the outgoing side 22 for three-pole supply lines without inserted power lines. The supply lines are laid into the adapter top, then the positioned line wires are pushed in together with the adapter bottom and latched in place.

Figure 4:
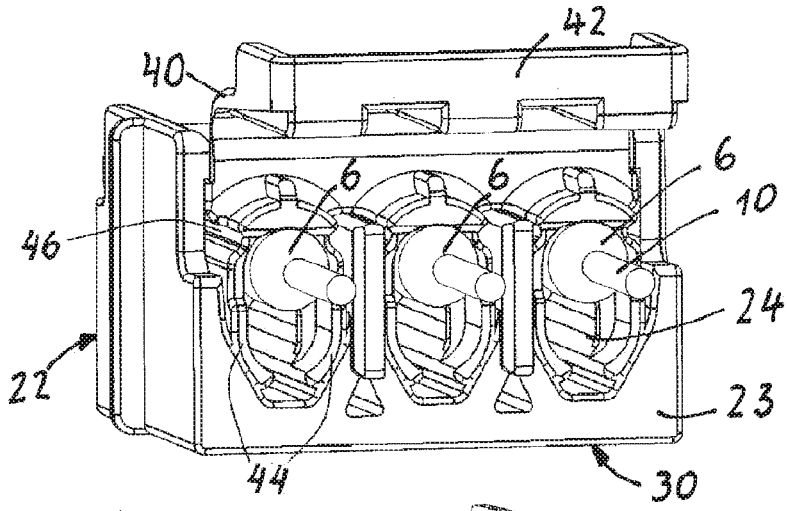
FIG. 4 two-part plug adapter, with inserted supply line wires.

FIG. 4 shows the two-part plug adapter 30 as viewed towards the incoming side 23 with inserted supply line wires 6.

Figure 5:
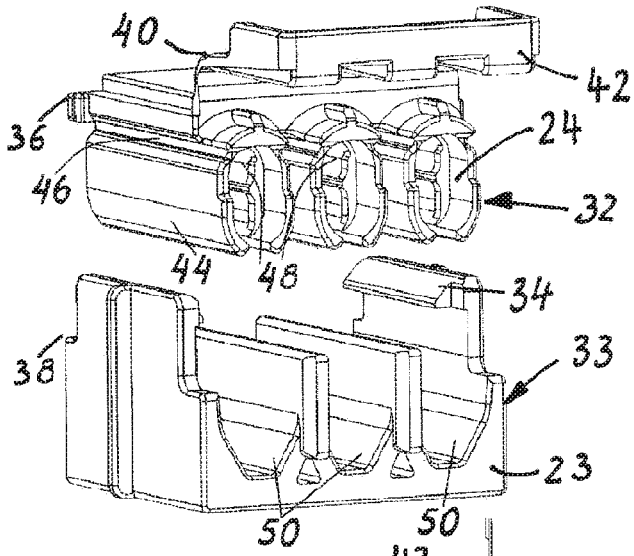
FIG. 5 adapter top and adapter bottom of a two-part plug adapter.

FIG. 5 is a perspective exploded view of an adapter top 32 and an adapter bottom 33 of a two-part plug adapter. As in the case of the single-piece plug adapter 20, there is a resilient actuation bar 42 on the top 31 of the two-part plug adapter 30.

In FIGS. 4 and 5, special emphasis is given to the fact that there are elastically movable clamping jaws 44 for purposes of clamping the supply line wires. The clamping jaws 44 are arranged in the adapter top 32 by means of film hinges 46. Moreover, in order to better affix the inserted supply line wires, there are clamping ribs 48 (on both sides) on the inner surfaces of the clamping jaws 44. The clamping ribs run parallel to the orientation of the clamping jaws 44 that define the receiving channel. The adapter top 32 has a holding edge 34 that secures both parts during the latching procedure. The adapter bottom 33 has U-shaped receiving troughs 50 that, when the adapter top 32 and the adapter bottom 33 are being assembled, especially move the clamping jaws 44 towards each other in the lower area of the receiving troughs and ultimately bring about the clamping effect.

Figure 6:
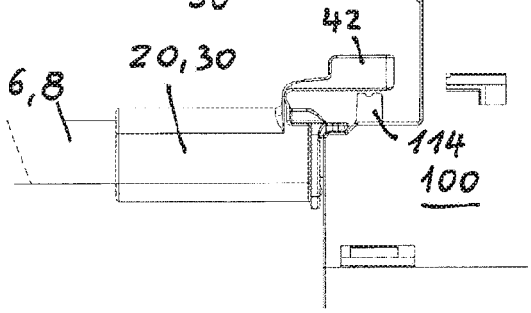
FIG. 6 side view of a plugged-in, one-part plug adapter.

FIG. 6 provides a side view of a plugged-in, one-part plug adapter. A plug adapter 20, 30 is connected to the electrical device via the supply line wires. The length of the actuation bar 42 is comparable to that of the ends of the supply line wires and extends in the direction of the incoming side of the device, thus being situated above the decoupling finger 114.

Figure 7:
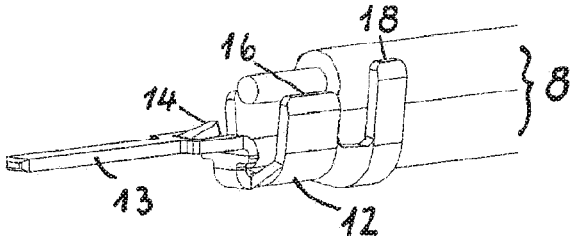
FIG. 7 conductor terminating element of a double wire.

FIG. 7 shows a conductor terminating element of a supply line configured as a double wire. Each receiving channel 24 that serves to hold a crimp contact 12 that compresses a supply line wire 6, 8 is formed in a plug adapter configured for such conductor terminating elements.

A conductor terminating element configured as a special variant according to FIG. 7 consists of a crimp contact 12 in which the conductor ends 6, 8 of the double wires are electrically connected by means of the compression clamp 16. The compression clamp (crimp) 18 for the wire insulation (conductor sheath) has correspondingly longer legs than the conductor compression clamp 16. In the depicted form, an electric double wire with a conductor cross section of, for instance, 2 $mm^2$ or 2.5 $mm^2$, can be laid into a receiving channel of a plug adapter. Such a measure allows two three-pole supply lines to be manufactured in a "doubled" form and to be prepared for establishing the connection to an electrical device.

The free conductor pin (contact blade 13) of the crimp contact protrudes from the plug adapter and can be plugged directly into the connection contacts of the electrical device. The contact blades of the crimp contact latch into the connection contacts. The configuration of the two compression clamps 16 and 18 on the contact blade 13 is a special feature of the crimp contact 12 shown as an extra configured partial area of the crimp contact. The crimp contact in the (one-part) plug adapter is affixed by means of the latching tab 14 configured on the crimp contact. Three of these crimp contacts shown in FIG. 7 can be placed into a three-pole plug adapter, thereby being inserted into the connection contacts and latched in place.

The conductor terminating element of a double wire depicted in FIG. 7 can also be used with a crimp contact for just a single supply line wire. In this context, for example, a supply line wire with a conductor cross section of up to 2.5 $mm^2$ could be used. Here, instead of the "doubled" form of the supply line described above, a fine-stranded conductor with a corresponding cross section is employed.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B, and C" should be interpreted as one or more of a group of elements consisting of A, B, and C, and should not be interpreted as requiring at least one of each of the listed elements A, B, and C, regardless of whether A, B, and C are related as categories or otherwise. Moreover, the recitation of "A, B, and/or C" or "at least one of A, B, or C" should be interpreted as including any singular entity from the listed elements, e.g., A, any subset from the listed elements, e.g., A and B, or the entire list of elements A, B, and C.

REFERENCE NUMERALS

2 multi-wire supply line
6 supply line wire, single flexible lead
8 double wire, double flexible lead
10 conductor terminating element
12 crimp contact
13 contact blade
14 latching tab
16 compression clamp (crimp) for the conductor
18 compression clamp (crimp) for the sheath
20 plug adapter (one-part housing)
21 top
22 incoming side
23 outgoing side
24 receiving channel
30 plug adapter having a two-part structure
31 top
32 adapter top
33 adapter bottom
34 holding edge
36 stop nose
38 undercut
40 film hinge
42 actuation bar
44 clamping jaws as receiving means
46 film hinge
48 clamping ribs
50 receiving trough
100 switching device
102 top
104 incoming side
106 actuation stroke

112 connection contact (push-in clamp)
114 unlocking element (decoupling finger)

The invention claimed is:

1. A plug adapter for an electrical device for plugging a multi-wire electric supply line into the electrical device, connection contacts of the device being positioned in a row next to each other in the device, and the connection contacts being contacted mechanically and electrically by the multi-wire electric supply line via screwless clamping elements, the clamping elements being released by actuating a supply line unlocking element that includes decoupling fingers configured to release the clamping elements and being positioned at 90° relative to an incoming direction of a conductor, and the decoupling fingers protruding by a length of their actuation stroke from a device housing in a direction of a top of the electrical device, the plug adapter comprising:

an approximately prismatic structure, the plug adapter including an insulating molded material;

a top that is parallel to the top of the electrical device;

an outgoing side facing the electrical device, the outgoing side being oriented in a direction of the connection contacts;

an incoming side facing away from the electrical device, the incoming side being configured to receive one or more supply line wires;

receiving channels arranged in parallel and located between the outgoing side and the incoming side, the receiving channels being configured to each receive a respective one of the supply line wires, the receiving channels being associated with the connection contacts of the electrical device; and an actuation bar that, in an inserted position of the plug adapter, is located above the supply line unlocking element, wherein the actuation bar is arranged on the plug adapter using a film hinge, and wherein the actuation bar is formed on the top of the plug adapter on the outgoing side of the receiving channels.

2. The plug adapter of claim 1, wherein a clearance of the receiving channels is dimensioned such that the receiving channels hold the supply line wires.

3. The plug adapter of claim 1, wherein each receiving channel is configured to hold an insulated single wire.

4. The plug adapter of claim 1, wherein each receiving channel is configured to hold a crimp contact configured to compress the respective supply line wire.

5. The plug adapter of claim 1, configured as a one-part plug adapter.

6. The plug adapter of claim 1, configured as a two-part plug adapter and further comprising:

an adapter top; and an adapter bottom.

7. The plug adapter of claim 6, wherein the adapter top and the adapter bottom include a receiver which permits the adapter top to be inserted into the adapter bottom, parallel to the receiving channels.

8. The plug adapter of claim 6, further comprising, on an outgoing side of the adapter bottom:

a stop nose configured for the adapter top, wherein, on the adapter top, the adaptor top includes an undercut associated with the stop nose.

9. The plug adapter of claim 6, wherein the actuation bar is located on the adapter top.

10. The plug adapter of claim 6, further comprising:

elastically movable clamping jaws, arranged in the adapter top using film hinges, wherein the elastically movable clamping jaws are configured to clamp the supply line wires.

11. The plug adapter of claim 6, wherein outgoing sides of the receiving channels are configured to hold the supply line wires.

12. A system comprising:

the adapter of claim 1; and the electrical device.

13. The system of claim 12, wherein the clamping elements are configured as push-in contact clamps.

14. A plug adapter for an electrical device for plugging a multi-wire electric supply line into the electrical device, connection contacts of the device being positioned in a row next to each other in the device, and the connection contacts being contacted mechanically and electrically by the multi-wire electric supply line via screwless clamping elements, the clamping elements being released by actuating a supply line unlocking element that includes decoupling fingers configured to release the clamping elements and being positioned at 90° relative to an incoming direction of a conductor, and the decoupling fingers protruding by a length of their actuation stroke from a device housing in a direction of a top of the electrical device, the plug adapter comprising:

an approximately prismatic structure, the plug adapter including an insulating molded material;

a top that is parallel to the top of the electrical device;

an outgoing side facing the electrical device, the outgoing side being oriented in a direction of the connection contacts;

an incoming side facing away from the electrical device, the incoming side being configured to receive one or more supply line wires;

receiving channels arranged in parallel and located between the outgoing side and the incoming side, the receiving channels being configured to each receive a respective one of the supply line wires, the receiving channels being associated with the connection contacts of the electrical device; and an actuation bar that, in an inserted position of the plug adapter, is located above the supply line unlocking element, wherein the plug adapter is configured as a two-part plug adapter and further comprises:

an adapter top, an adapter bottom, and elastically movable clamping jaws, arranged in the adapter top using film hinges, wherein the elastically movable clamping jaws are configured to clamp the supply line wires.

* * * * *